US006230845B1

(12) United States Patent
Yamakawa et al.

(10) Patent No.: US 6,230,845 B1
(45) Date of Patent: May 15, 2001

(54) MOVEABLE CONTROL PANEL FOR ELEVATORS

(75) Inventors: Shigeki Yamakawa; Hiroyuki Takagi; Junichiro Ishikawa; Seiji Okuda; Tatsushi Takahashi; Tomohiko Yao, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/463,429

(22) PCT Filed: Jul. 16, 1998

(86) PCT No.: PCT/JP98/03211

§ 371 Date: Jan. 27, 2000

§ 102(e) Date: Jan. 27, 2000

(87) PCT Pub. No.: WO00/03941

PCT Pub. Date: Jan. 27, 2000

(51) Int. Cl.[7] ..... B66B 3/00
(52) U.S. Cl. ..... 187/391; 187/314
(58) Field of Search ..... 187/391, 298, 187/250, 254, 313, 314, 316, 325, 414

(56) References Cited

U.S. PATENT DOCUMENTS

| | | | | |
|---|---|---|---|---|
| 4,832,159 | * | 5/1989 | Ikejima et al. | 187/129 |
| 4,875,552 | * | 10/1989 | Smith et al. | 187/1 R |
| 5,429,211 | * | 7/1995 | Aulanko et al. | 187/254 |
| 5,740,888 | * | 4/1998 | Aulanko et al. | 187/336 |
| 5,813,498 | * | 9/1998 | Hattori et al. | 187/324 |
| 6,006,866 | * | 12/1999 | Horne et al. | 187/316 |
| 6,148,962 | * | 11/2000 | Hakala et al. | 187/254 |

FOREIGN PATENT DOCUMENTS

| | | | | |
|---|---|---|---|---|
| 1-294178 | | 11/1989 | (JP) . | |
| 4-361974 | | 12/1992 | (JP) . | |
| 406080339 | * | 3/1994 | (JP) | 187/391 |
| 406219663 | * | 8/1994 | (JP) | 187/391 |
| 406239548 | * | 8/1994 | (JP) | 187/391 |
| 7-144857 | | 6/1995 | (JP) . | |
| 8-40675 | | 2/1996 | (JP) . | |
| 8-282933 | | 10/1996 | (JP) . | |
| 10-36023 | | 2/1998 | (JP) . | |

* cited by examiner

*Primary Examiner*—Jonathan Salata
(74) *Attorney, Agent, or Firm*—Leydig, Voit & Mayer, Ltd.

(57) ABSTRACT

A controller for an elevator. The elevator includes a landing passageway where a car stops and passengers board or alight and a hoistway through which the car is raised or lowered. A control panel for controlling the raising, lowering, and stopping of the car is disposed in the hoistway at a position where the control panel does not interfere with the raising or lowering of the car, and a mechanism for drawing out the control panel to the landing passageway is provided. Accordingly, space in the hoistway is effectively used, and the landing passageway which passengers do not use during maintenance can be readily utilized for a maintenance operation.

10 Claims, 7 Drawing Sheets

MOVEABLE CONTROL PANEL FOR ELEVATORS

TECHNICAL FIELD

The present invention relates to a controller for an elevator which is disposed in a hoistway so as to control the operation of the elevator.

BACKGROUND ART

In a conventional elevator system, since a traction machine, a control panel, and the like are installed in a machinery room disposed above a hoistway, it is necessary to secure a space for the machinery room at an uppermost portion of a building, so that the utilization ratio of the building declines, and the height of the building becomes high. Accordingly, an elevator has been proposed which does not require the machinery room by installing the winding machine and the control panel inside the hoistway. However, in adjustment or maintenance of the control panel, it is poor in the operating efficiency for an operator to directly enter the interior of the hoistway and engage in the operation, and it has been proposed to install the control panel in the vicinity of a landing of the elevator.

For example, Japanese Patent Application Unexamined Publication No. 282933/1996 discloses a landing of the elevator in which the control panel is disposed in a door pocket portion of the landing door, an openable door covering this door pocket is provided, and at the time of maintenance of the control panel this door is opened to perform the operation. However, the space in front of the control-panel maintenance door, which is located on a side of the landing door of the elevator is not necessarily left as a vacant space serving as the work space, and there are cases where furniture or furnishings are placed there, so that a need arises to move them each time the door is opened and closed. Incidentally, as for the maintenance door facing the landing, its design features are possibly sacrificed to realize the opening/closing structure.

In addition, Japanese Patent Application Examined Publication No. 33223/1995 discloses an arrangement in which the control panel is disposed on the rear side of a jamb, and after the jamb is removed, the maintenance operation for the control panel is performed from the landing passageway. However, the control panel is located on the rear side of the jamb, and is accommodated in a narrow space between the jamb and a landing wall. Although it may be possible to draw out the maintenance surface during maintenance, this system is applicable only to a small control panel for a small elevator, and cannot be applied if the size of the control panel becomes large.

DISCLOSURE OF THE INVENTION

The present invention has been devised to overcome the above-described problems, and its object is to obtain a controller for an elevator which makes it possible to perform a maintenance operation without moving furniture and furnishings on the side of the landing when performing the maintenance of the control panel, and which can be applied to a larger control panel without being restrained by the size of the jamb.

A controller for an elevator in accordance with the present invention is a controller for an elevator which includes a landing passageway where a car stops and passenges board or alight and a hoistway through which the car is raised or lowered, wherein a control panel for controlling the raising, lowering, and stopping of the car is disposed in the hoistway and at a position where the control panel does not interfere with the raising or lowering of the car, and a mechanism for drawing out the control panel to the landing passageway is provided.

BEST MODE FOR CARRYING OUT THE INVENTION

Figure 1:
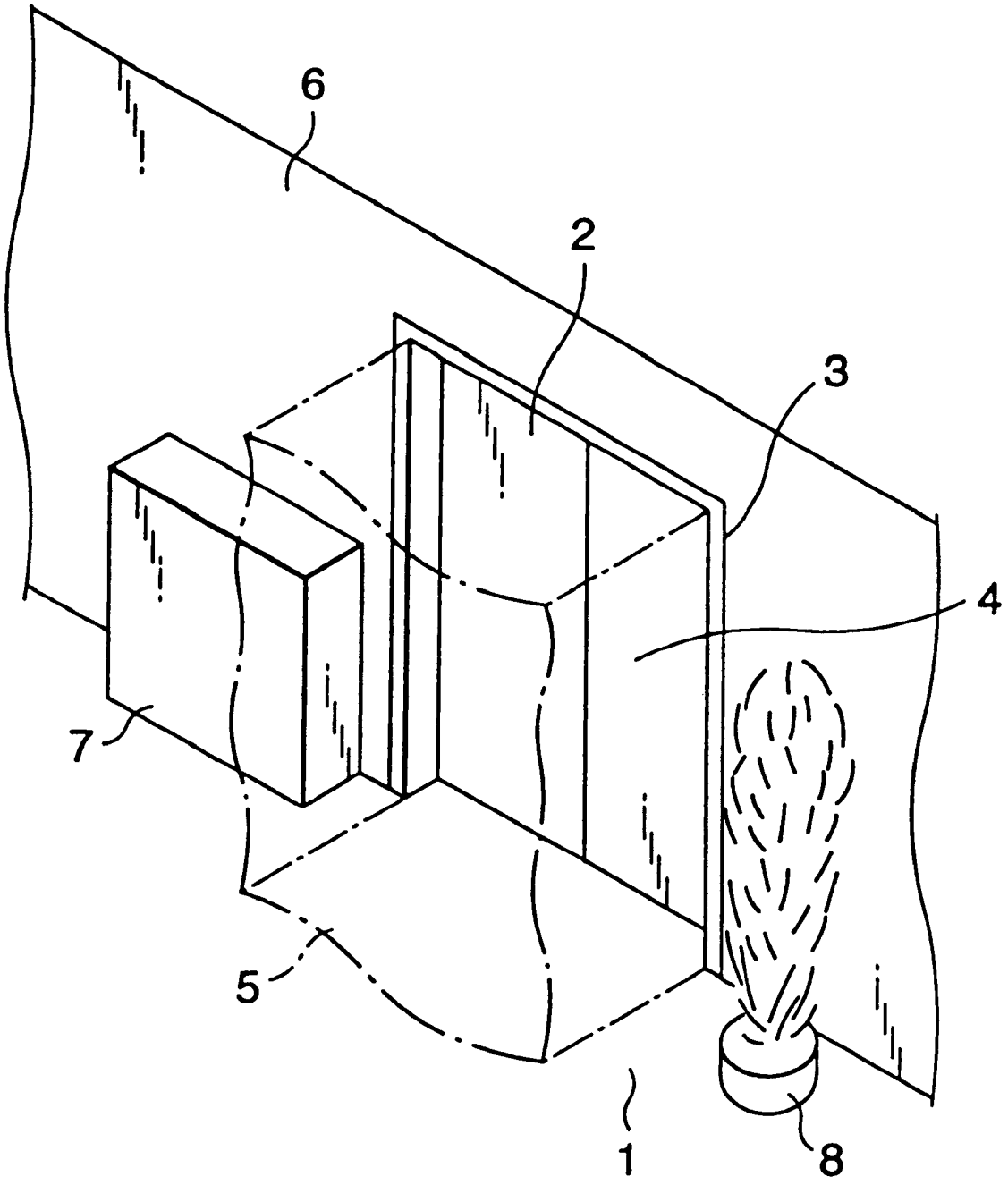
FIG.1 (PRIOR ART)
FIG. 1 is a perspective view illustrating a landing passageway which is subject to the present invention.

Referring to the drawings, a description will be given hereafter of the preferred embodiments of the present invention.

FIG. 1 is a perspective view illustrating a landing passageway which is subject to the present invention. In the drawing, an entrance 4 is formed by landing doors 2 and a jamb 3 at a landing 1 for an elevator, and a landing passageway 5 is provided in front of the entrance 4 for passengers to enter or leave the elevator. Furniture 7 and furnishings 8 are placed along a landing wall 6 at positions where they do not interfere with the landing passageway 5 on left and right sides of the entrance 4.

First Embodiment

Figure 4:
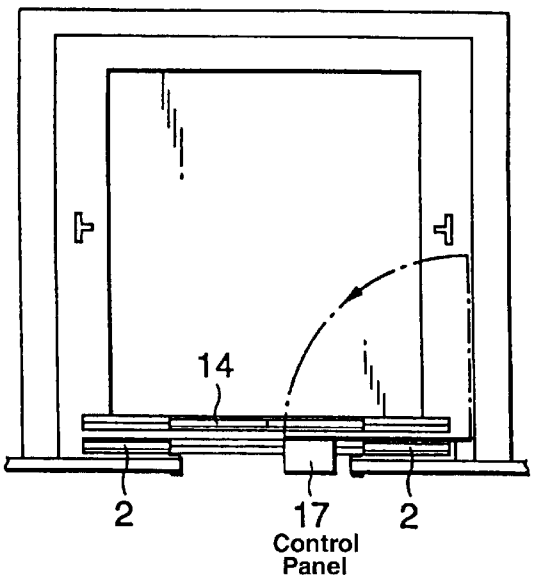
FIG. 4 is a plan view illustrating the state at the time of a maintenance operation in FIG. 2.
Figure 5:
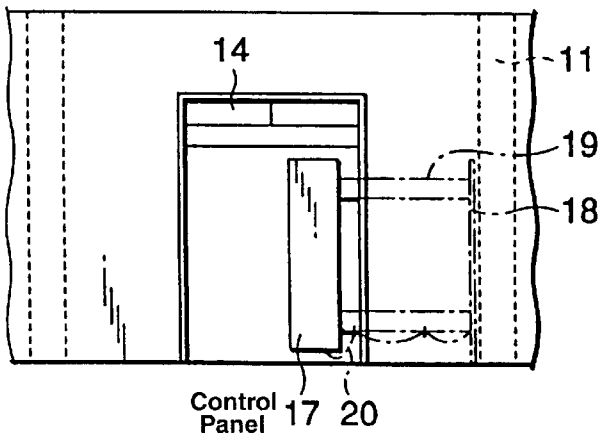
FIG. 5 is a front elevational view taken from the landing side in FIG. 4.
Figure 2:
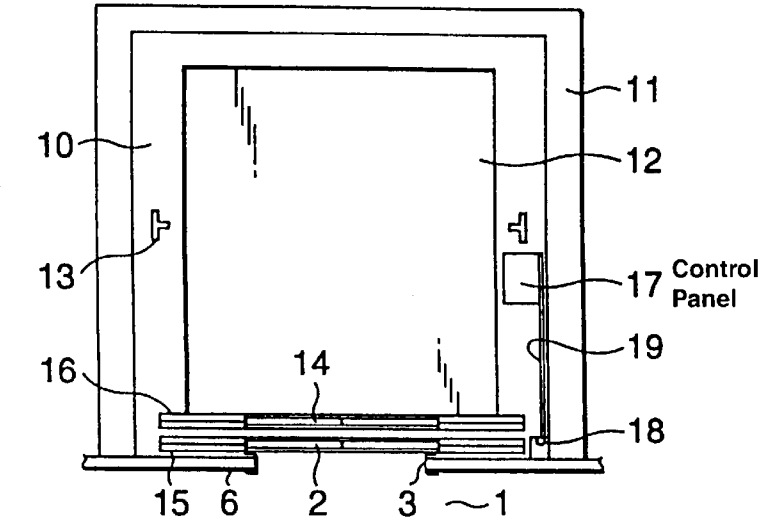
FIG. 2 is a plan view of an elevator controller in accordance with a first embodiment of the present invention.
Figure 3:
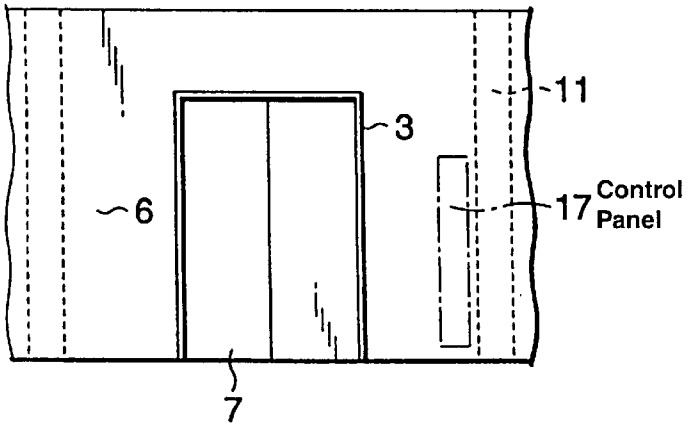
FIG. 3 is a front elevational view taken from the landing side in FIG. 2.

FIG. 2 is a plan view of an elevator controller in accordance with a first embodiment of the present invention; FIG. 3 is a front elevational view taken from the landing side in FIG. 2; FIG. 4 is a plan view illustrating the state at the time of a maintenance operation in FIG. 1; and FIG. 5 is a front elevational view taken from the landing side in FIG. 4.

In the drawings, a hoistway 10 is disposed on the opposite side of the landing 1 with the landing doors 2 or the landing wall 6 placed therebetween, and this hoistway 10 is formed in such a way as to be surrounded by the landing wall 6 and hoistway walls 11. An elevator car 12 for passengers to board and adapted to be raised or lowered is disposed in the hoistway 10, and the car 12 is guided by rails 13. At positions facing the landing doors 2, the car 12 has car doors 14 through which the passengers enter or leave. The landing doors 2 and the car doors 14 which are opened or closed have a landing sill 15 and a car sill 16, respectively, for guiding the opening or closing. In addition, a control panel 17 for controlling the operation of the elevator is provided in the hoistway 10, and is disposed rotatably by means of a column 18 fixed to the hoistway 10 as well as attaching arms 19. Further, the control panel 17 transmits and receives electric power or a signal through a cable 20.

In such an elevator, since the control panel 17 is disposed inside the hoistway 10, a special room for installing the control panel, i.e., a machinery room, can be made unnecessary or small. In addition, when it is necessary to access the control panel due to a maintenance operation or the like, after the landing doors 2 are opened, the control panel 17 is rotated about the column 18 so as to be moved to the landing passageway 5, thereby allowing the operator to engage in the operation in the landing passageway 5 without moving the furnature 7 and the furnishings 8 in front of the landing wall 6. At this time, since the control panel 17 and the attaching arms 19 holding the control panel 17 are moved to a position where they do not interfere with the car 12 or the car sill 16 and the car doors 14, it becomes possible for the car 12 to pass that floor.

On the building side, the provision of a maintenance door for a space for accommodating the control panel in such a manner as to face the landing or living quarters or the passageway in the vicinity of the landing has the possibility of impairing the design features of the building. In this application, however, such a possibility does not arise since there is no need to provide a new door.

By virtue of the above-described present invention, when operation and inspection are directly required with respect to the control panel for the purpose of maintenance or other similar operations, the control panel can be easily drawn out to the landing passageway which can be easily secured as a working area, and the control panel can be readily accommodated in the hoistway during the normal operation. Further, during the maintenance operation there are cases where the landing doors are opened and the movement of the car is monitored; however, the control panel located at the landing passageway blocks a part of the opened entrance of the landing as a fence, thereby contributing to the enhancement of the safety of the operation during the operation.

In addition, although details are not shown in FIG. 4, in accordance with the present invention, the two landing doors 2 may be temporarily moved to one side away from the control panel 17 to clear a part of the landing, and after a portion of the jamb 3 is opened, the control panel 17 may be drawn out therefrom to the landing passageway, and subsequently the landing doors 2 may be closed again. In this way, the maintenance operation can be performed without leaving the landing doors open, and the safety of the operator can be further enhanced.

Second Embodiment

Figure 8:
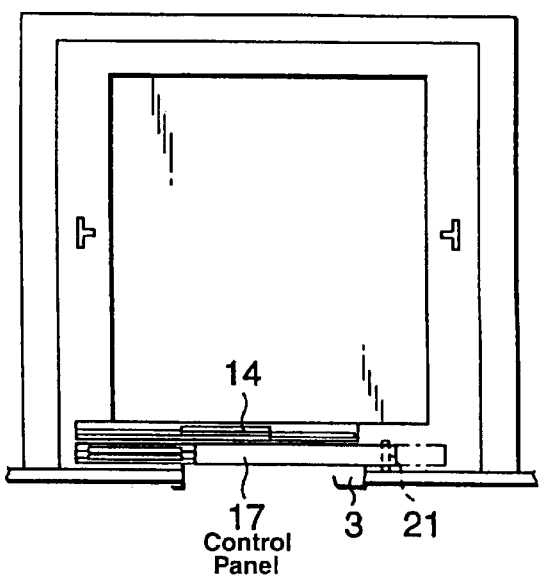
FIG. 8 is a plan view illustrating the state at the time of the maintenance operation in FIG. 6.
Figure 6:
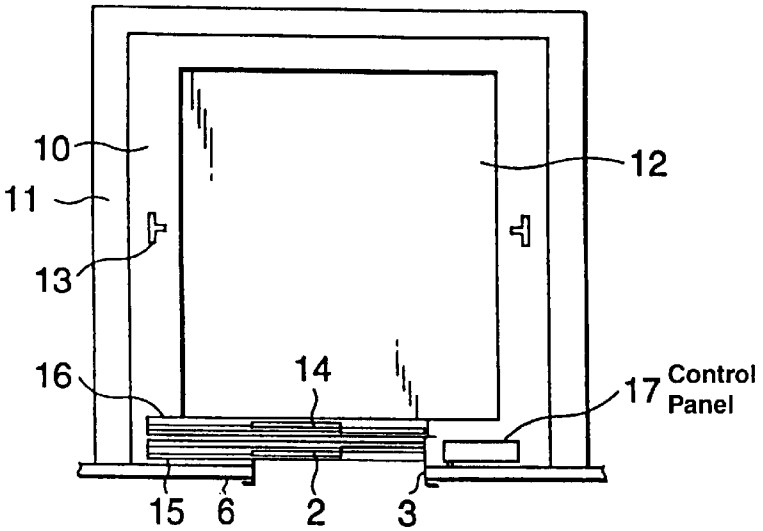
FIG. 6 is a plan view of an elevator controller in accordance with a second embodiment of the present invention.
Figure 9:
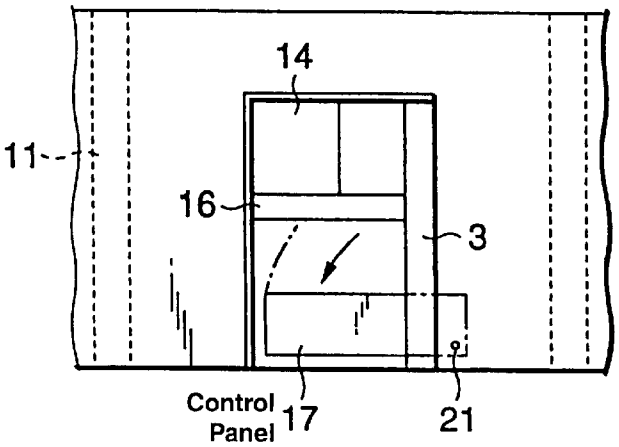
FIG. 9 is a front elevational view taken from the landing side in FIG. 8.
Figure 7:
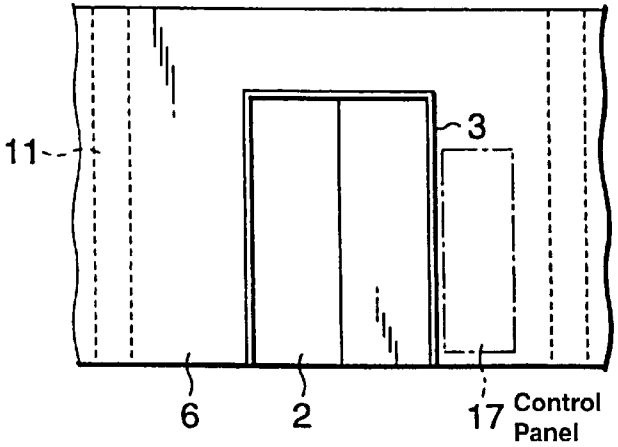
FIG. 7 is a front elevational view taken from the landing side in FIG. 6.

FIG. 6 is a plan view of an elevator controller in accordance with a second embodiment of the present invention; FIG. 7 is a front elevational view taken from the landing side in FIG. 6; FIG. 8 is a plan view illustrating the state at the time of a maintenance operation in FIG. 6; and FIG. 9 is a front elevational view taken from the landing side in FIG. 8.

In the drawings, the same elements as those of the foregoing embodiment are denoted by the same reference numerals. The control panel 17 is disposed in the hoistway 10 on the rear side of the landing wall 6. When a maintenance operation is performed with respect to the control panel, the landing doors 2 are opened, the portion of the jamb 3 on the control panel 17 side is opened, and the control panel 17 is rotated in a direction along the landing sill about a supporting shaft 21 which pivotally supports the control panel 17, and the control panel 17 is laid on the landing passageway 5.

In such an elevator, since the control panel 17 is disposed inside the hoistway 10 in the same way as the foregoing embodiment, the machinery room can be made unnecessary or small, and an operation can be performed at the landing passageway 5 during the maintenance operation. In addition, since the control panel 17 can be drawn out to the landing passageway 5 without causing the control panel 17 to jut out to the car 12 side from the landing sill 15, the car can be operated to pass that floor during the maintenance operation.

It should be noted that although, in this embodiment, the arrangement has been illustrated in which the doors are retracted to one side as described above, a similar advantage can be obtained with an arrangement in which the doors are respectively retracted to both sides. In addition, although the control panel is disposed on the right-hand side as viewed from the landing, it is evident that a similar advantage can be obtained even if the control panel is disposed on the left-hand side.

In addition, in this embodiment, the landing doors 2 and the car doors 14 at the time of their opening are retracted only to the rear side of the landing wall 6 on one side with respect to the landing 4. Consequently, the control panel 17 is disposed at the position where it does not interfere with the car 12 which is raised or lowered, in the rear of the landing wall 6 on one side away from the side to which the doors are retracted. The thickness of the landing doors 2, i.e., the thickness of at least two doors in this embodiment, can be secured as the thickness of the control panel 17. Incidentally, the operation can be performed with the landing doors 2 closed during the maintenance, as has been described in the foregoing embodiment. Particularly in this system, the direction in which the landing doors are opened at the time of drawing out the control panel is the same as the direction in which they are normally opened, and the thickness of the control panel can be easily secured, so that this arrangement is convenient.

Third Embodiment

Figure 10:
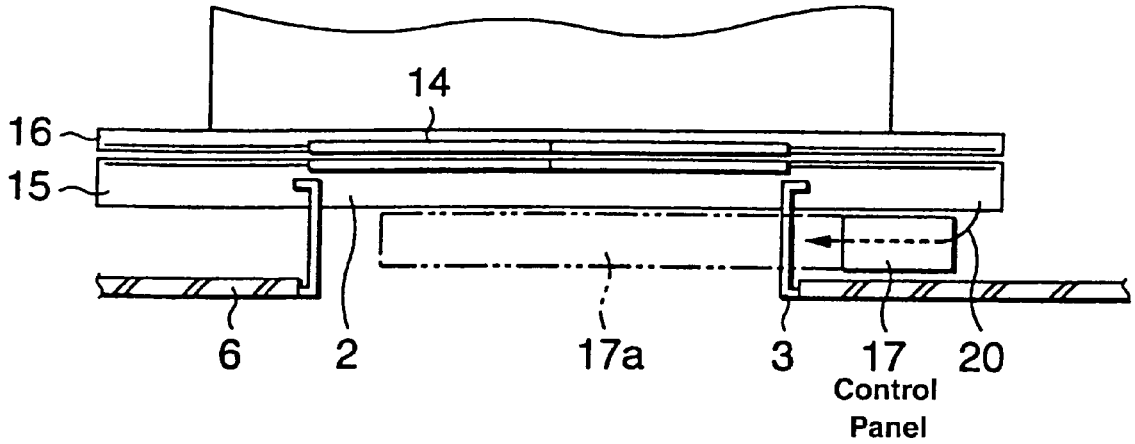
FIG. 10 is a plan view illustrating the state at the time of the maintenance operation in accordance with a third embodiment of the present invention.
Figure 11:
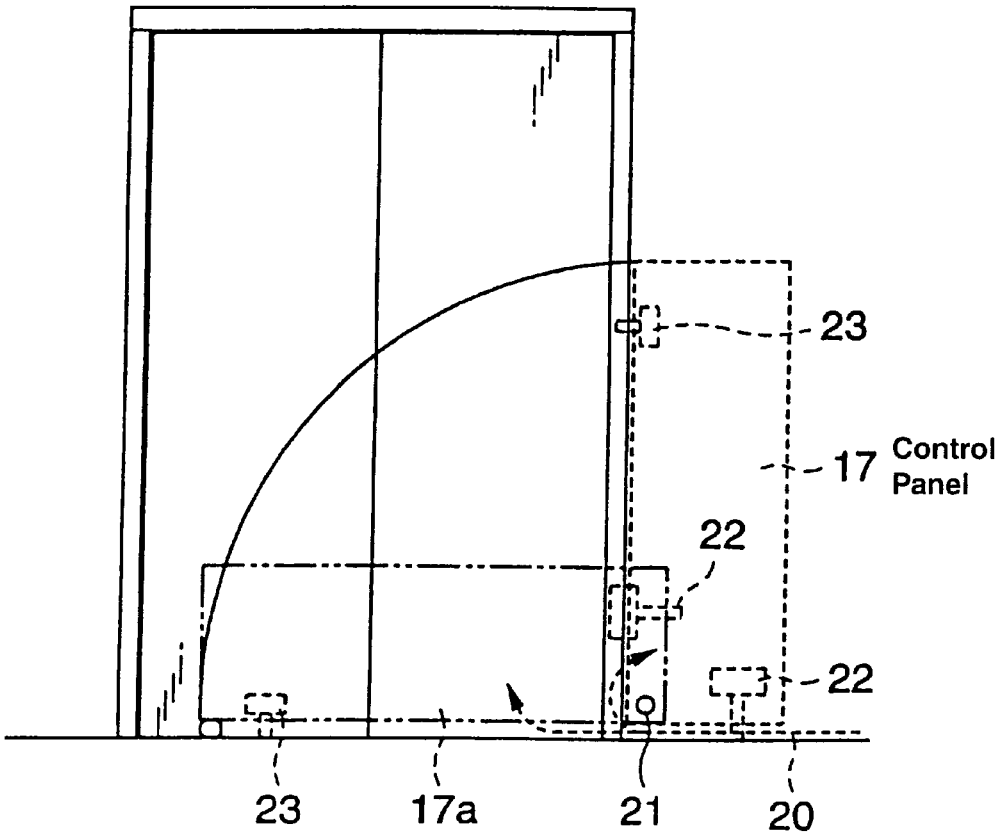
FIG. 11 is a front elevational view taken from the landing side in FIG. 10.

In a third embodiment of the present invention, some arrangements are modified and new arrangements are added to the invention shown in the second embodiment. FIG. 10 is a plan view illustrating the state at the time of a maintenance operation in accordance with this third embodiment, and FIG. 11 is a front elevational view taken from the landing side in FIG. 10.

In the drawings, the same elements as those of the foregoing embodiments are denoted by the same reference numerals. The control panel 17 is disposed in the hoistway 10 on the rear side of the landing wall 6 in the same way as the above-described second embodiment. The cable 20 for transmitting and receiving electric power and a signal to and from the control panel 17 is routed on the outer side of the supporting shaft 21 for rotating the control panel 17 and is connected to the control panel 17. Mounted on the control panel 17 are an accommodated-position detector 22 for detecting that the control panel 17 is accommodated in the hoistway 10 as well as a maintenance-position detector 23 for detecting that the control panel 17 has been drawn out to the landing passageway 5. Incidentally, the control panel 17*a* at a maintenance position is indicated by the two-dotted dash lines.

In such an elevator, the fact that the control panel 17 is accommodated in the hoistway 10 can be detected by the accommodated-position detector 22. Namely, in this example, as a projecting portion of the accommodated-position detector 22 engages the landing sill 15, an unillustrated built-in switch operates to permit detection. In addition, the fact that the control panel 17 has reached the maintenance position can be detected by the maintenance-position detector 23 provided on a side portion of the control panel 17. Namely, in this example, as the maintenance-position detector 23 and the landing sill 15 engage each other, an unillustrated built-in switch operates to permit detection. Further, at this time, since the cable 20 is passed around the vicinity of the supporting shaft 21 for the control panel 17 which rotates, and is connected to the inside of the control panel 17, even if the control panel 17*a* is inclined to the maintenance operation position, the cable 20 does not become taut. Although the cable 20 is wound around the outer side of the supporting shaft 21 and is connected to the control panel, a similar advantage can be obtained even if the cable 20 is wound around the inner side thereof, and is passed around the vicinity of the supporting shaft with slight leeway. These advantages are derived from the fact that the supporting shaft is provided in the main body of the control panel.

The present invention is arranged as described above, and the normal operation for general passengers is allowed only when it is detected by the accommodated-position detector 22 that the control panel 17 has been returned to its accommodating position, though details are not shown. Further, the normal operation is not allowed when it is not detected that the control panel 17 is at its accommodating position. In addition, only when it is detected by the maintenance-position detector 23 that the control panel 17 is at its proper maintenance position in the landing passageway 5, the raising or lowering of the car is allowed with the landing doors 2 open by way of a maintenance operation by an expert, and the passing of that floor is allowed. The operation subsequent to each detection can be realized by a known eleverator running operation, so that its details will not be given herein.

Thus, in the present invention, there is provided a mechanism whereby the control panel, which is disposed at the position where it does not interfere with the raising or lowering of the car in the hoistway, is drawn out to the landing passageway for the purpose of maintenance or the like, and the method of operation of the elevator is changed depending on whether the control panel is at its proper position in the hoistway or whether it is at its proper position for the maintenance operation. Therefore, the present invention exhibits the function of enhancing the safety in the management of the operation.

It should be noted that, in this embodiment, the landing doors 2 and the car doors 14 are of the type in which they are respectively drawn separately to the rear side of the landing wall 6 on both sides of the landing when they are opened. Further, after the portion of the jamb 3 on the control panel 17 side is removed, the control panel 17 is drawn out to the landing passageway 5. The accommodated-position detector 22 and the maintenance-position detector 23 are not limited to those having the built-in switches of this example, and they suffice if they are capble of detecting the positions of the control panel 17. In addition, the positions of the detectors are not limited to the illustrated positions, either, and their shapes and structures are not limited to the illustrated ones.

Fourth Embodiment

Figure 12:
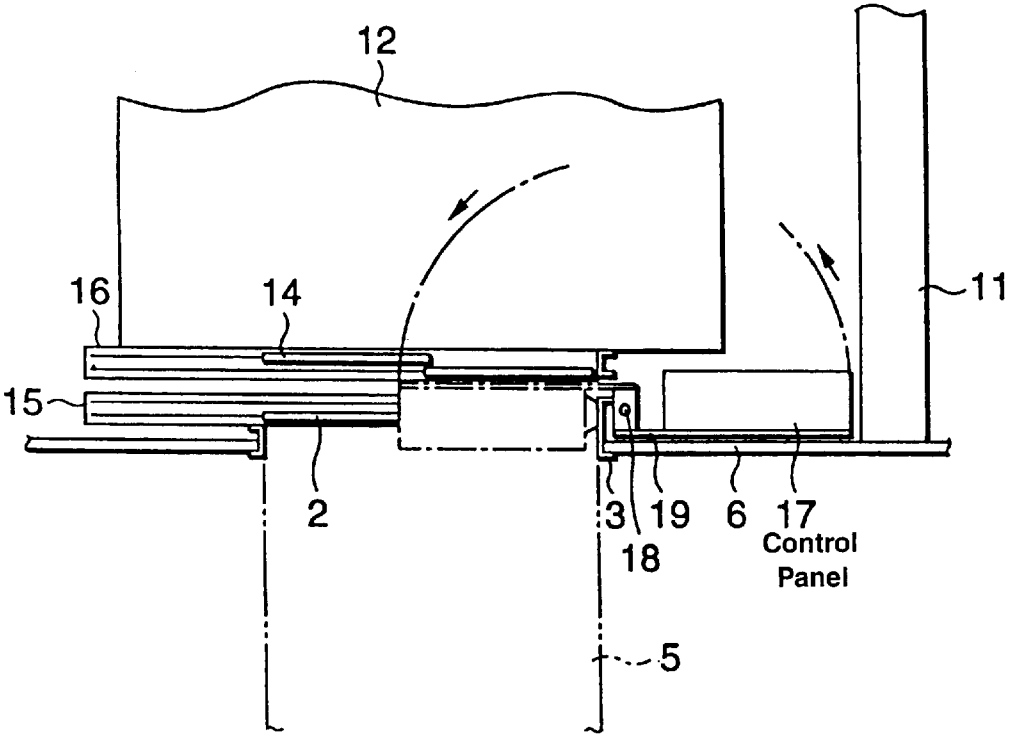
FIG. 12 is a plan view illustrating the movement of a control panel at the time of the maintenance operation in accordance with a fourth embodiment.

In a fourth embodiment of the present invention, some arrangements in the first embodiment are modified, and FIG. 12 is a plan view illustrating the movement of the control panel at the time of the maintenance operation in accordance with this fourth embodiment.

In the drawing, the same elements as those of the foregoing embodiments are denoted by the same reference numerals. In this example, the column 18 is fixedly disposed in parallel to the vertical frame portion of the jamb 3, and the control panel 17 is held at the distal ends of the attaching arms 19 extending from the column 18 serving as the supporting shaft for the control panel 17. At normal times, the control panel 17 and the attaching arms 19 are accommodated in the hoistway 10 in parallel to the landing wall 6.

In such an elevator, during maintenance, the control panel 17 held by the attaching arms 19 is rotated to the landing passageway 5 about the column 18 (supporting shaft) which is in close proximity and in parallel to the jamb 3 forming a portion of the landing passageway 6, so as to perform the operation.

In this embodiment, since the column is provided in parallel to the vertical direction of the jamb 3, i.e., the space forming the landing passageway, the length of the attaching arms of the control panel can be short, so that the structure and arrangement can be simplified.

Fifth Embodiment

Figure 13:
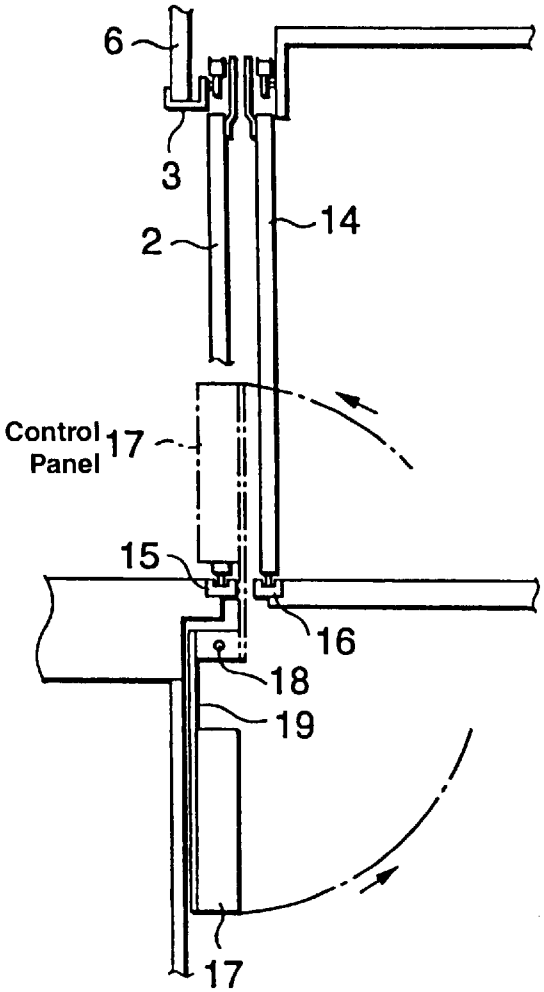
FIG. 13 is a plan view illustrating the movement of the control panel at the time of the maintenance operation in accordance with a fifth embodiment.

In a fifth embodiment of the present invention, some arrangements in the fourth embodiment are modified, and FIG. 13 is a plan view illustrating the movement of the control panel at the time of the maintenance operation in accordance with this fifth embodiment.

In the drawing, the same elements as those of the foregoing embodiments are denoted by the same reference numerals. In this example, the column 18 is fixedly disposed in parallel to the landing sill 15, and the control panel 17 is held at the distal ends of the attaching arms 19 extending from the column 18 serving as the supporting shaft for the control panel 17. At normal times, the control panel 17 and the attaching arms 19 are accommodated below the landing sill 15 in the hoistway 10.

In such an elevator, during maintenance, the control panel 17 suspended and held by the attaching arms 19 is rotated and raised to the landing passageway 5 about the column 18 (supporting shaft) which is downwardly in close proximity and in parallel to the landing sill 15 forming a portion of the landing passageway 6, so as to perform the operation.

In this embodiment, since the column is provided in parallel to the landing sill, i.e., in the horizontal direction of the space forming the landing passageway, the length of the attaching arms of the control panel can be short, so that the structure and arrangement can be simplified. In addition, the landing sill is frequently provided projectingly in the hoistway, and in this embodiment effective use is made of the space in the hoistway below the sill. Furthermore, although in this embodiment the control panel is accommodated below the sill, a similar advantage can be offered if the column is provided in parallel to a hanger 25 at the landing, which will be described later, and if the control panel is accommodated in the space above the hanger 25 in the hoistway.

Sixth Embodiment

Figure 14:
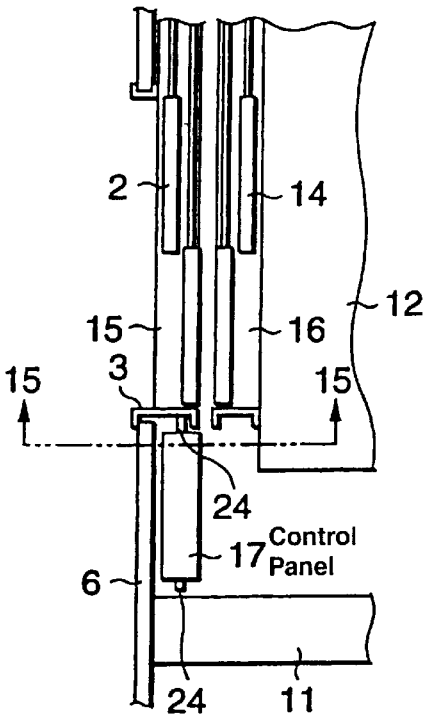
FIG. 14 is a plan view of the elevator controller in accordance with a sixth embodiment of the present invention.
Figure 16:
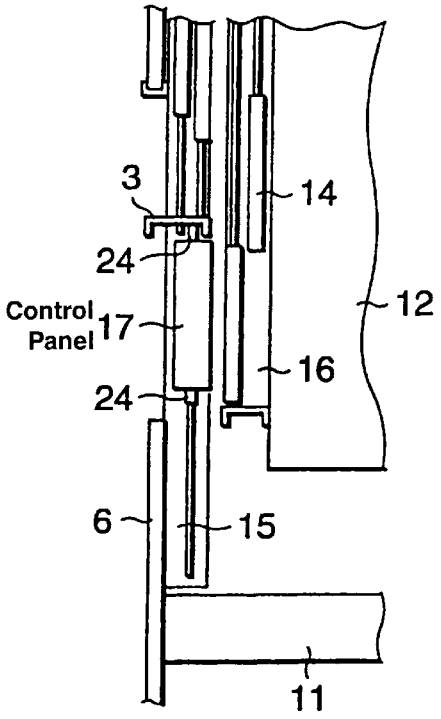
FIG. 16 is a plan view illustrating the state during the maintenance operation in FIG. 14.
Figure 15:
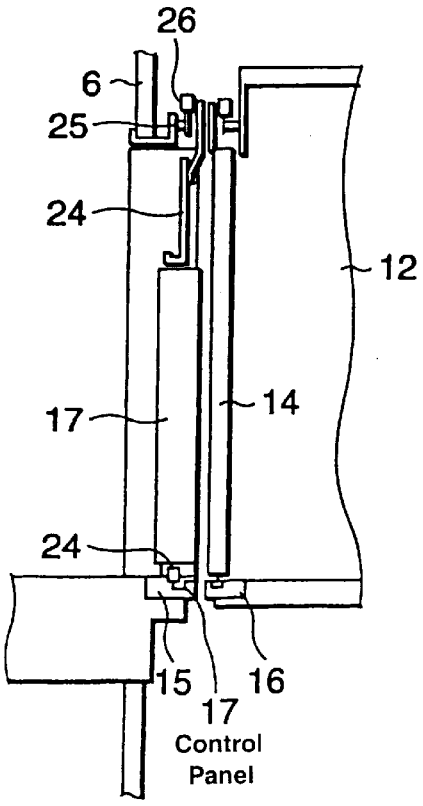
FIG. 15 is a side elevational view taken along section 15—15 in FIG. 14.

FIG. 14 is a plan view of the elevator controller in accordance with a sixth embodiment of the present invention; FIG. 15 is a side elevational view taken along section 15—15 in FIG. 14; and FIG. 16 is a plan view illustrating the state during a maintenance operation in FIG. 14.

In the drawings, the same elements as those of the foregoing embodiments are denoted by the same reference numerals. The vertical frame portion of the jamb 3 which is close to the control panel 17 is attached to an attaching frame 24 for holding the control panel 17 disposed in the hoistway in parallel to the landing wall 6. This attaching frame 24 has its lower portion guided by a groove 27 of the hoistway sill 15 and its upper portion guided and suspended by the hanger 25 for the landing doors 2 by means of rollers 26.

In such an elevator, after the landing doors 2 are opened and retracted to the rear of the landing wall 6, if the attaching frame 24 is drawn out to the landing passageway 5 while being guided by the hanger 25 for the landing doors 2 and the groove 27 of the landing sill 15, the operator is able to perform the operation at the landing passageway 5.

Although in this example the landing sill 15 and the hanger 25 are used as guides for drawing out the control panel to the landing passageway, the present invention is not limited to the same, and a similar advantage can be obtained even in the case of an arrangement in which a rail or the like exclusively used for the control panel is formed as a guiding device. In addition, the accommodating position of the control panel in the hoistway is not limited to the rear side of the landing wall in the manner shown in FIG. 14. For example, an arrangement may be adopted such that the control panel is accommodated at a position along the hoistway wall 11 close to the rail 13 for the car 12 as shown in FIG. 2, and a guiding device having a curved portion is used when the control panel is drawn out to the landing passageway 5.

In addition, although in the above-described embodiment, the hanger and the sill groove on the car-side door of the landing doors are used as the guiding device for the control panel, it is possible to use as the guiding device the hanger and the sill groove used for the landing door on the side close to the landing wall in the drawing. In this case, if the thickness of the control panel is set to a dimension which does not interfere with the car-side landing door, it becomes possible to draw out the control panel without opening the landing doors.

Seventh Embodiment

Figure 17:
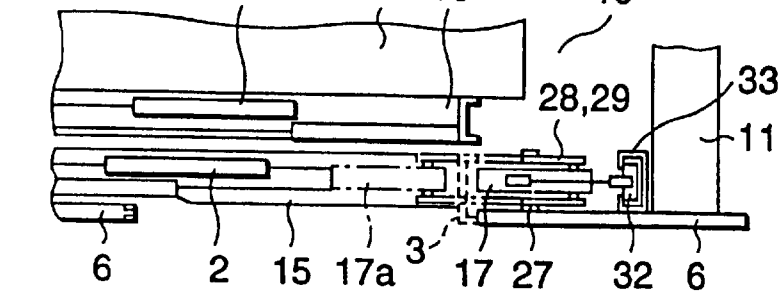
FIG. 17 is a plan view of the elevator controller in accordance with a seventh embodiment of the present invention.
Figure 18:
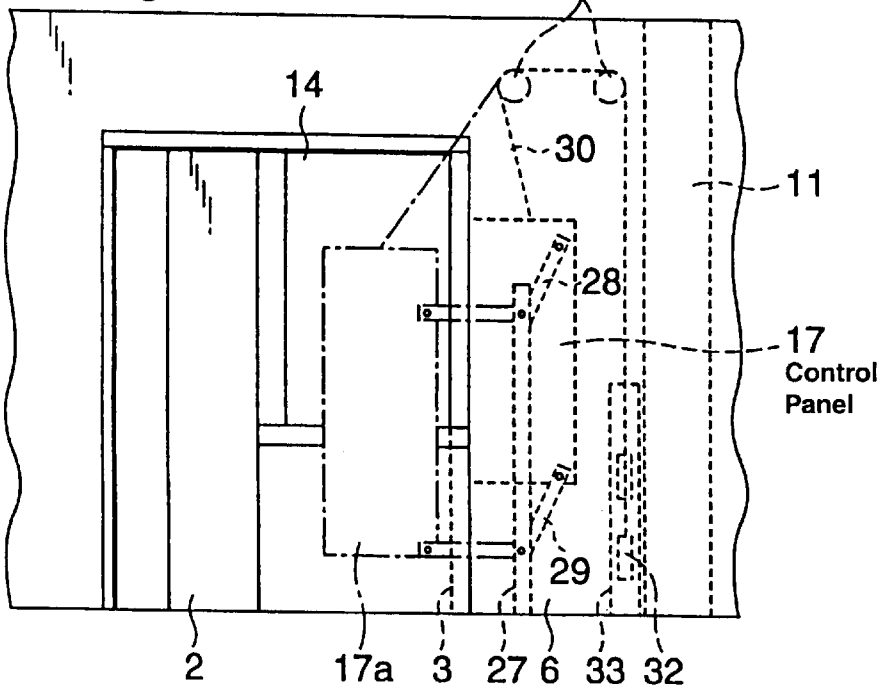
FIG. 18 is a plan view taken from the landing side in FIG. 17.

FIG. 17 is a plan view of the elevator controller in accordance with a seventh embodiment of the present invention, and FIG. 18 is a plan view taken from the landing side in FIG. 17.

In the drawings, the same elements as those of the foregoing embodiments are denoted by the same reference numerals. The control panel 17 is disposed in the hoistway 10 on the rear side of the landing wall 6 and is supported by a column 28. The mechanism provided is such that the control panel 17 can be drawn out to the landing passageway 5 by means of an upper link 28 and a lower link 29 as with the control panel 17*a* shown by the dot-dashed line in FIGS. 17 and 18. The control panel 17 is pulled upward by one end of a suspending rope 30, and the suspending rope 30, after being wound around rotating sheaves 31, is extended downward in the rear, a weight 32 being suspended from the other end of the suspending rope 30. The raising or lowering of the weight 32 is guided by a weight guide 33.

In such an elevator, the weight of the weight 32 is set to be lighter than the weight of the control panel. At normal times, since the control panel 17 is located at a porition in which it is drawn into the hoistway by the upper link 28 and the lower link 29, and the weight of the weight 32 is light, the control panel 17 is stably received by an unillustrated stopper with its own weight of that difference. During the maintenance operation, after the control panel 17-side vertical frame portion of the jamb 3 is removed, the control panel 17 can be drawn out to the landing passageway 5 by means of the upper link 28 and the lower link 29. At this time, since the weight 32 is connected to control panel 17 by means of the suspending rope 30 as a balancer for obtaining an equilibrium, an operating force at the time of drawing out the control panel 17 is alleviated as compard with the actual weight of the control panel. Incidentally, the same also holds true of the case where the control panel 17 is returned for accommodation in the hoistway 10.

As described above, in this embodiment, the control panel accommodated in the hoistway is readily drawn out to the landing passageway by means of the link mechanism. At this time, the weight of the car is balanced by the balancer, i.e., the balancer consisting of the suspending rope and the weight in this embodiment, thereby making it possible to alleviate the operating force. In addition, the balancer is not limited to the mechanism of this embodiment, and may be formed by a traction mechanism for producing a traction force, such as a spring.

Eighth Embodiment

Figure 19:
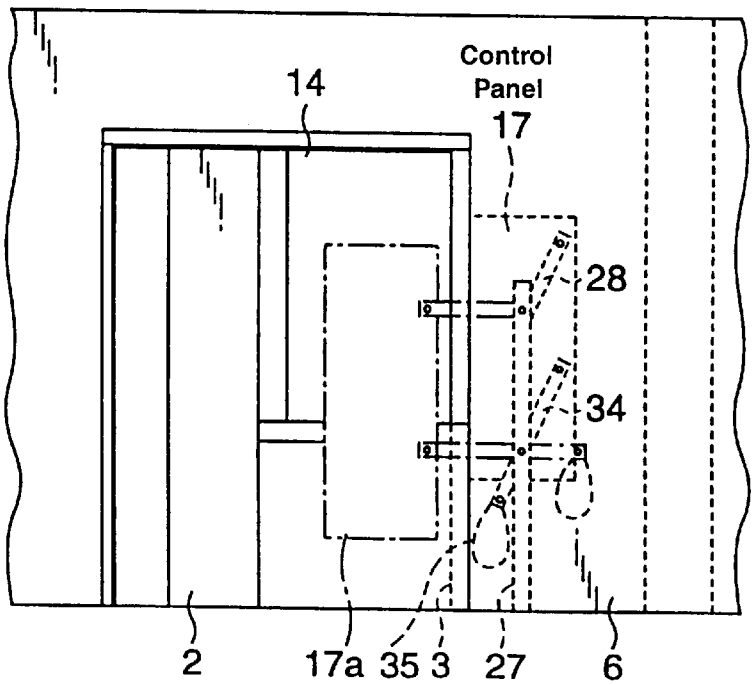
FIG. 19 is a front elevational view, taken from the landing side, of the elevator controller in accordance with an eighth embodiment of the present invention.

FIG. 19 is a front elevational view, taken from the landing side, of the elevator controller in accordance with an eighth embodiment of the present invention.

In the drawing, the same elements as those of the foregoing embodiments are denoted by the same reference numerals. In this embodiment, the lower link 29 used in the foregoing seventh embodiment, which has one end supporting the control panel 17, is further extended from the column 27 for rotating and supporting the link to form the other end from which position a suspending weight 35 is suspended, so as to balance part of the weight of the control panel. Accordigly, when the control panel 17 is drawn out from the hoistway 10 or when it is returned for accommodation in the hoistway 10, the control panel 17 can be operated with a force lighter than the weight of the control panel.

This embodiment thus makes use of the weight which is directly suspended from the link as the balancer.

INDUSTRIAL APPLICABILITY

At normal times, the control panel is accommodated in the hoistway at a position which does not hamper the raising or lowering of the car, and the control panel is drawn out to the landing passageway, as necessary, to allow a maintenance and adjustment operation. As a result, a special room for accommodating the control panel as in the case of the conventional machinery room is not required, space saving can be attained, and the control panel can be simply drawn out to the landing passageway by the mechanism for drawing out the control panel to the landing, thereby making it possible to perform the maintenance operation. It should be noted that the landing passageway is normally open in a state permitting the passage of passengers for boarding or alighting, and during maintenance the landing passageway is naturally a space which is not required for the passage of the passengers, so that it is possible to draw out the control panel to this position and perform the operation. Accordingly, the maintenance personnel is able to easily access the control panel, and a maintenance space can be secured. Furthermore, at the time of adjustment of the elevator there are cases where adjustment is effected while observing the movement of the car in the hoistway, but since the elevator doors at the landing passageway can be left open, its movement can be observed easily. In addition, since the drawn-out control panel blocks a part of the landing passageway, so that an advantage is produced as a safety fence for an intruder into the landing passageway or the maintenance personnel.

In addition, when the control panel is not at the proper position in the hoistway, the accommodated-position detecting switch does not operate, but since in such a case there is the possibility of an interference and a collision between the car and the control panel inside the hoistway, the operation of the elevator to the position where the control panel is installed is prevented, thereby making it possible to obviate a collision.

In addition, when the control panel is at the proper position in the landing passageway, the maintenance-position detecting switch operates, but since in such a case there is no possibility of an interference and a collision between the car and the control panel inside the hoistway, the operation of the elevator to the position where the control panel is installed is allowed, and it is possible to open the doors at the landing for adjustment of the control panel, thereby making it possible to visually confirm the movement of the elevator.

Furthermore, the landing wall differs from other hoistway walls, and is generally formed by a thin wall so as to install the jamb or a door mechanism for the landing. Such landing equipment is not necessarily disposed over the entire landing wall, and it is so difficult to secure a space for installing the control panel without interfering with the car in the hoistway. Here, the control panel installed along the landing wall inside the hoistway is rotated about the supporting shaft or column provided in parallel to the landing passageway, and is drawn out to the landing passageway. Namely, a simple control-panel drawing-out mechanism is provided by making effective use of one of the spaces in the four directions on the hoistway side of the landing wall and surrounding the landing passageway.

In addition, since the control panel is pivotally supported at its lower end by the supporting shaft on the landing passageway side, the operation when the control panel is drawn out to the landing passageway is a pulling-down operation while being rotated, so that the operation can be performed easily.

In addition, the cable length when the control panel is drawn out does not change much in its form as compared with the cable length when the control panel is accommodated, so that the cable does not become taut in conjunction with the movement of the control panel.

Further, since the movement of the control panel is effected smoothly by the control-panel guiding device, and much of the weight of the control panel is borne, the control panel can be readily drawn out to the landing passageway.

Further, since the hanger and the sill for the landing doors installed at the landing are made use of as the control-panel guiding device, it is unnecessary to newly install an exclusive-use control-panel guiding device in the vicinity of the landing passageway, so that the arrangement becomes simple.

Further, since the link mechanism provided with the balancer for canceling the weight of the control panel is adopted, it becomes unnecessary for the operator to handle the entire weight of the control panel when drawing out the control panel to the landing passageway accommodating it in the hoistway, so that handling is facilitated.

What is claimed is:

1. An elevator and controller comprising:

a car which is raised and lowered with passengers on board;

a landing passageway where said car stops and passengers enter and leave said car;

a hoistway having at least one surface defined by a landing wall including said landing passageway and other surfaces defined by hoistway walls, and through an interior of which said car is raised and lowered, and a control panel for controlling the raising, lowering, and stopping of said care disposed in said hoistway at a position where said control panel does not interfere with raising and lowering of said car, and a mechanism for drawing said control panel into said landing passageway.

2. The controller for an elevator according to claim 1, including an accommodated-position detecting switch for detecting when said control panel is at the position where said control panel does not interfere with the raising and lowering of said car in said hoistway, and when said accommodated-position detecting switch does not detect that said control panel is at the position where said control panel does not interfere with said car, operation of said elevator to where said control panel is located is prevented.

3. The controller for an elevator according to claim 1, including a maintenance-position detecting switch for detecting when said control panel is at a position where said control panel has been drawn into said landing passageway, and when said control panel is detected by said maintenance-position detecting switch, raising and lowering of said car being allowed with a landing door open only at a floor where said landing passageway into which said control panel has been drawn is located, and operation of said elevator is allowed up to the floor where said control panel has been drawn out.

4. The controller for an elevator according to claim 1, wherein said control panel is disposed substantially parallel to said landing wall on a hoistway side of said landing wall that includes said landing passageway, and including a supporting shaft pivotally supporting said control panel, parallel to said landing passageway, and having at least a portion fixed, and a mechanism for rotating said control panel about said supporting shaft and for drawing said control panel into said landing passageway.

5. The controller for an elevator according to claim 4, wherein said pivotally supporting shaft is located proximate a lower end of said control panel on the landing passageway side.

6. The controller for an elevator according to claim 4, including a cable for transmitting and receiving electric power and a signal to and from said control panel, routed said supporting shaft for rotating said control panel and connected to said control panel.

7. The controller for an elevator according to claim 1, including a control-panel guiding device for supporting said control panel from a control-panel installed portion in said hoistway to said landing passageway, and a mechanism for drawing said control panel into said landing passageway along said control-panel guiding device.

8. The controller for an elevator according to claim 7, wherein said landing passageway is partitioned from said hoistway by a landing door, and cluding a hanger disposed at a higher position in said landing passageway for suspending said landing door, and a sill disposed at a lower position in said landing passageway for guiding said door, and said hanger and said sill are used as said control-panel guiding device to draw said control panel to said landing passageway.

9. The controller for an elevator according to claim 1, wherein said control panel is disposed substantially parallel to said landing wall on a hoistway side of said landing wall including said landing passageway, and said control panel is fixed by a link mechanism for drawing said control panel into said landing passageway.

10. The controller for an elevator according to claim 9, wherein said link mechanism supporting said control panel includes a balancer which balances weight of said control panel.

* * * * *